US012729594B2

(12) United States Patent
Church et al.

(10) Patent No.: US 12,729,594 B2
(45) Date of Patent: Sep. 8, 2026

(54) APPARATUS FOR AND METHOD OF CUTTING THROUGH OR DEFORMING A SIDEWALL OF A DOWNHOLE TUBULAR

(71) Applicant: KASEUM HOLDINGS LIMITED, Aberdeen Aberdeenshire (GB)

(72) Inventors: Paul Andrew Church, Aberdeen Aberdeenshire (GB); Stewart Christie, Aberdeen Aberdeenshire (GB); Andrew John Elrick, Peterhead Aberdeenshire (GB); Peter Alan Joiner, Danstone (GB); Iain Morrison Macleod, Kingseat (GB); Jason Duthie, Aberdeen (GB)

(73) Assignee: KASEUM HOLDINGS LIMITED, Aberdeen Aberdeenshire (GB)

( * ) Notice: Subject to any disclaimer, the term of this patent is extended or adjusted under 35 U.S.C. 154(b) by 0 days.

(21) Appl. No.: 18/880,482

(22) PCT Filed: Jun. 29, 2023

(86) PCT No.: PCT/GB2023/051707
§ 371 (c)(1),
(2) Date: Dec. 31, 2024

(87) PCT Pub. No.: WO2024/003561
PCT Pub. Date: Jan. 4, 2024

(65) Prior Publication Data

US 2025/0389167 A1 Dec. 25, 2025

(30) Foreign Application Priority Data

Jul. 1, 2022 (GB) ..... 2209720

(51) Int. Cl.
*E21B 29/00* (2006.01)
*E21B 43/112* (2006.01)

(52) U.S. Cl.
CPC ..... *E21B 29/005* (2013.01); *E21B 43/112* (2013.01)

(58) Field of Classification Search
CPC ..... E21B 29/005; E21B 29/007; E21B 29/08
See application file for complete search history.

(56) References Cited

U.S. PATENT DOCUMENTS 3,050,122 A * 8/1962 Huitt ..... E21B 47/095 175/269
3,720,262 A 3/1973 Grable
(Continued)

FOREIGN PATENT DOCUMENTS

WO 2008101021 A2 8/2008

OTHER PUBLICATIONS

Combined Search and Examination Report under Sections 17 & 18(3) dated Nov. 9, 2022 received in GB2209720.8.
(Continued)

*Primary Examiner* — Tara Schimpf
*Assistant Examiner* — Lamia Quaim
(74) *Attorney, Agent, or Firm* — HUNTON ANDREWS KURTH LLP

(57) ABSTRACT

An apparatus (102) for cutting through or deforming a sidewall of a downhole tubular. The apparatus (102) comprises a housing (1) having a cylinder (18) provided therein and at least one radially moveable body member (15) located within and radially moveable within said cylinder. The housing (1) comprises a fluid port (11) to permit fluid to flow into and out of a fluid chamber (13) of the housing (1). The body member (15) is radially moveable from a retracted position to extended position by introduction of fluid through said fluid port (11) into said fluid chamber (13). The body member (15) is radially moveable from the extended
(Continued)

position to the retracted position by withdrawal of fluid through said fluid port (11) from said fluid chamber (13).

25 Claims, 8 Drawing Sheets

(56) References Cited

U.S. PATENT DOCUMENTS

| | | | | |
|---|---|---|---|---|
| 2014/0138091 | A1 | 5/2014 | Hughes | |
| 2016/0258257 | A1* | 9/2016 | Babin | E21B 29/005 |
| 2019/0120004 | A1 | 4/2019 | Castillo | |
| 2019/0264547 | A1 | 8/2019 | Kerst | |
| 2020/0102815 | A1 | 4/2020 | Hrupp | |
| 2021/0032948 | A1* | 2/2021 | Stewart | E21B 23/01 |

OTHER PUBLICATIONS

Search Report under Section 17 dated Nov. 8, 2022 received in GB2209720.8.
Combined Search and Examination Report under Sections 17 & 18(3) dated Nov. 27, 2023 received in GB2309927.8.
Search Report under Section 17 dated Nov. 24, 2024 received in GB2309927.8.

* cited by examiner

APPARATUS FOR AND METHOD OF CUTTING THROUGH OR DEFORMING A SIDEWALL OF A DOWNHOLE TUBULAR

TECHNICAL FIELD OF THE INVENTION

The present invention relates to an apparatus and method for circumferentially deforming and/or cutting through the sidewall of a downhole tubular, such as a production tubing or other downhole tubular such as drill pipe or casing, at a particular axial or vertical location and more particularly, but not exclusively, relates to an apparatus and method for circumferentially deforming and/or performing a cut through the sidewall of a downhole tubular, the cut comprising a 360° cut having the same starting and finishing circumferential location such that the downhole tubular is cut into two sections which are no longer connected, the two portions comprising an upper tubular portion and a lower tubular portion.

BACKGROUND OF THE INVENTION

In the exploration and/or exploitation of hydrocarbons, such as oil and/or gas, it is often necessary to deform a downhole tubular such as production tubing, drill pipe or casing radially outwardly and/or to cut through the sidewall of the downhole tubular in order, for example, to cut the downhole tubular in two such that it now constitutes an upper portion or length of downhole tubular and a lower portion or length of downhole tubular which have been separated at the point of the cut such that for example the upper portion can be removed from the wellbore.

There are various methods known in the art to the skilled person for deforming a downhole tubular such as pushing or pulling a deformable cone through the inner through bore of the downhole tubular.

In relation to performing a horizontal cut in order to cut all the way through the sidewall of the downhole tubular around the full 360° of the circumference of the tubular, there are several techniques known to the person skilled in the art, many of which use a lathe type cutting tool which requires to be powered from the surface via for example e-line, where the lathe type cutting tool comprises a cutting element such as a circular saw and which is rotated at relatively high speed and is brought to bear against one point on the inner surface of the throughbore of the downhole tubular such that the circular blade cuts through the sidewall of the downhole tubular at that one point on the circumference and is then moved (i.e. rotated) around the inner circumference in order to cut through the sidewall of the full 360° of the circumference of the tubular. However, such lathe circular blade tools require a lot of power to be delivered via the e-line from the surface; that isn't a particular problem but e-line is relatively expensive to run and requires an extensive safety program due to the relatively high levels of current and voltage involved.

It is an object of the present invention to provide embodiments of downhole deformation and/or cutting tool which can be run downhole on a wireline and more preferably on a slickline (which is a much lower cost, safer and more straight forward method of running tools downhole than e-line) (or another work string which isn't required to transmit power) and which require much less power such that they could be operated and powered via batteries (contained in a power control module run with the bottom hole assembly at the lower end of the slickline and which also contains the deformation and/or cutting tool). Embodiments of the present invention may be able to provide an deformation and/or cutting tool which is (in the order of a magnitude or greater) lower cost than prior art deformation and/or cutting tools.

Statements of Invention

According to a first aspect of the present invention, there is provided an apparatus for cutting through or deforming a sidewall of a downhole tubular, the apparatus comprising:

a housing having a cylinder provided therein;

at least one radially moveable body member having a contact surface formed on an outer surface thereof, wherein the body member is located within and is radially moveable within the cylinder such that the contact surface is moveable between a retracted position and an extended position for at least contacting the inner surface of a throughbore of the downhole tubular, wherein the contact surface comprises an arc length which extends, from end to end, greater than 18°;

wherein the body member comprises a piston;

wherein the housing comprises a fluid chamber defined by at least one inner surface of the cylinder and an innermost face of the piston;

wherein the housing further comprises a fluid port to permit fluid to flow into and out of said fluid chamber;

wherein the body member is radially moveable from the retracted position to the extended position by introduction of fluid though said fluid port into said fluid chamber; and wherein the body member is radially moveable from the extended position to the retracted position by withdrawal of fluid through said fluid port from said fluid chamber.

Advantageously, having the introduction and withdrawal of fluid through the same fluid port provides an operator with a greatly simplified apparatus compared to similar apparatus described in the state of the art as only one fluid chamber and piston face are required to move the body member back and forth between the retracted and extended positions. Additionally, this maximises the potential stroke of the body member between the retracted and extended positions.

Typically, the piston acts to seal an outer end of the chamber between the body member and an inner surface of the cylinder wherein the piston preferably comprises a seal which is preferably slidable and which acts between an outer surface of the body member and an inner surface of the cylinder. Optionally, the piston is provided at or towards the innermost end of the body member and more preferably, the body member comprises the piston being provided at its innermost end. This has the advantage of maximising the potential stroke of the body member between the retracted and extended positions.

Typically, the apparatus is provided with a separate fluid reservoir in fluid communication with said fluid chamber, typically via said fluid port. Typically, the body member is radially moveable from the retracted position to the extended position by introduction of fluid from said separate fluid chamber though said fluid port into said fluid chamber. Typically, the body member is radially moveable from the extended position to the retracted position by withdrawal of fluid from said fluid chamber through said fluid port and into said separate fluid chamber.

Typically, said separate fluid reservoir, said fluid chamber and components connected therebetween, preferably including said fluid port, make up a closed system typically having a fixed volume of fluid therein. In other words, there is no exchange of fluid between the closed system and its surroundings, such as an outer wellbore within which the downhole tubular is located, in operation of the apparatus. In particular, fluid is neither released from nor introduced into the closed system during operation.

Typically fluid introduced into the fluid chamber will act against an inner piston face of the piston.

Typically the body member comprises a biasing mechanism configured to bias the body member radially inwards.

Typically the apparatus is configured to connect to a hydraulic actuator tool. Typically the hydraulic actuator tool is configured to introduce fluid into the fluid chamber and typically withdraw fluid from the fluid chamber. Typically the hydraulic actuator tool is configured to introduce fluid into the fluid reservoir and typically withdraw fluid from the fluid reservoir. Typically the hydraulic actuator tool is configured to introduce fluid into the fluid reservoir which is withdrawn from said fluid chamber and typically withdraw fluid from the fluid reservoir and introduce said fluid into the said fluid chamber. Typically the separate fluid reservoir is provided within the hydraulic actuator tool.

According to a second aspect of the present invention there is provided a method of cutting through or deforming a sidewall of a downhole tubular, the method comprising the steps of:

a) running an apparatus in accordance with the first aspect of the present invention into the throughbore of the downhole tubular;
b) moving said at least one radially moveable body member from a retracted position to an extended position such that the contact surface at least contacts the inner surface of the throughbore of the downhole tubular by introducing fluid through said fluid port into said fluid chamber;
c) moving said at least one radially moveable body member from the extended position to the retracted position by withdrawing fluid through said fluid port from said fluid chamber; and
d) rotating the radially moveable body member around a longitudinal axis of the radially moveable body member.

Preferably, the method further comprises repeating steps b), c) and d) as required and/or as many times as required until the contact surface(s) have made contact with 360° of the inner surface of the throughbore of the downhole tubular.

Typically, the body member is radially moveable outwards in order to move the contact surface into contact with the inner throughbore of the downhole tubular by introduction of fluid into said fluid chamber. Typically, the body member is radially moveable inwards in order to move the contact surface away from the inner throughbore of the downhole tubular by withdrawal of fluid from said fluid chamber.

Preferably, the ends of the contact surface coincide with the same part circumferential plane (i.e. the plane that is perpendicular to the longitudinal axis of the apparatus), such that when the contact surface is rotated which may be by operation of an indexer apparatus, one of the ends will be aligned where the other end had previously made contact with the inner surface of the throughbore of the downhole tubular.

Preferably, the said ends of the contact surface comprise a first end point and a second end point, where the first and second end points are distinct from one another and are at opposite ends of the arc length from one another. In preferred embodiments, all points on the arc length, including the two end points, are preferably all coincident on the same plane (that plane being perpendicular to the longitudinal axis of at least one of and preferably both of the radially moveable body member and the downhole tubular).

Preferably, the arc length of the contact surface is in the range of 20° to 180° and is more preferably in the range of 30° to 90° and is most preferably 60°.

Preferably, the radially moveable body member is rotated in step d) by an arc length equal to the arc length of the contact surface.

Typically, the contact surface comprises a radius and said radius may be substantially the same as the radius of the downhole tubular to be contacted by the contact surface.

Optionally, the contact surface comprises a different radius to the radius of the downhole tubular to be contacted by the contact surface.

Typically, the contact surface comprises a blade surface adapted to cut through the sidewall of the downhole tubular.

Optionally, the contact surface comprises a deformation surface adapted to deform the sidewall of the downhole tubular radially outwards.

Preferably, the apparatus is adapted to be rotated within the throughbore of the downhole tubular about the longitudinal axis of the apparatus and is more preferably adapted to be rotated within the throughbore of the downhole tubular about the longitudinal axis of the apparatus by the same arc length as that of the contact surface. Typically, the apparatus is adapted to be rotated within the throughbore of the downhole tubular about the longitudinal axis of the apparatus such that the contact surface remains on the same circumferential plane (which is preferably perpendicular to the longitudinal axis of the apparatus). Typically, the apparatus is adapted to be rotated within the throughbore of the downhole tubular about the longitudinal axis of the apparatus whilst the contact is in the retracted position. Typically, the apparatus is adapted to be rotated within the throughbore of the downhole tubular about the longitudinal axis of the apparatus by an indexer tool connected thereto.

Typically, the apparatus is adapted to be run into the throughbore of the downhole tubular to the required location downhole with the contact surface is in the retracted position.

Typically, the apparatus is adapted to be run into the throughbore of the downhole tubular on a work string. Preferably, the work string is preferably an elongate member and more preferably is a cable or wire and more preferably is a wireline and most preferably is a slickline.

Preferably, the apparatus is provided within a bottom hole assembly and which more preferably comprises a power supply within said bottom hole assembly and thus obviates the need for power to be transmitted from the surface. Preferably, the bottom hole assembly comprises the hydraulic actuator tool, preferably powered by the power supply and more preferably actuatable using a linear actuator tool powered by the power supply. Preferably the linear actuator tool actuates the hydraulic actuator tool by providing a motive force to the hydraulic actuator tool. Preferably the bottom hole assembly comprises the indexer tool. Preferably the hydraulic actuator tool is configured to actuate the indexer tool. Preferably the bottom hole assembly further comprises an anchor assembly adapted to anchor the bottom hole assembly and thus the apparatus in axial position within the wellbore. Preferably the linear actuator tool is configured to actuate the anchor assembly.

More preferably, the contact surface comprises an arc length which extends from end to end in the range of from 20° (which would result in 18 rotations of the rotatably moveable body member being required for making contact with 360° of the inner surface of the throughbore of the downhole tubular) to 180° (which would result in two rotations being required) and even more preferably from 30° (which would result in 12 rotations being required) to 90° (which would result in four rotations being required) preferably from 45° (which would result in eight rotations being required) to 72° (which would result in five rotations being required) and is most preferably in the region of 60° (which would result in six rotations being required).

Preferably, the retracted position of the contact surface has the contact surface spaced apart from the inner surface of the throughbore of the downhole tubular and typically, the contact surface is wholly located within the apparatus when in the retracted position (such that it does not extend further outwards from the apparatus than other portions of the apparatus).

Preferably, the extended position of the contact surface has the contact surface in contact with the inner surface of the throughbore of the downhole tubular.

The accompanying drawings illustrate presently exemplary embodiments of the disclosure and together with the general description given above and the detailed description of the embodiments given below, serve to explain, by way of example, the principles of the disclosure.

In the description that follows, like parts are marked throughout the specification and drawings with the same reference numerals, respectively. The drawings are not necessarily to scale. Certain features of the invention may be shown exaggerated in scale or in somewhat schematic form, and some details of conventional elements may not be shown in the interest of clarity and conciseness. The present invention is susceptible to embodiments of different forms. Specific embodiments of the present invention are shown in the drawings and herein will be described in detail, with the understanding that the present disclosure is to be considered an exemplification of the principles of the invention and is not intended to limit the invention to that illustrated and described herein. It is to be fully recognised that the different teachings of the embodiments discussed below may be employed separately or in any suitable combination to produce the desired results.

The following definitions will be followed in the specification. As used herein, the term "wellbore" refers to a wellbore or borehole being provided or drilled in a manner known to those skilled in the art. The wellbore may be 'open hole' or 'cased', being lined with a tubular string. Reference to up or down will be made for purposes of description with the terms "above", "up", "upward", "upper" or "upstream" meaning away from the bottom of the wellbore along the longitudinal axis of a work string toward the surface and "below", "down", "downward", "lower" or "downstream" meaning toward the bottom of the wellbore along the longitudinal axis of the work string and away from the surface and deeper into the well, whether the well being referred to is a conventional vertical well or a deviated well and therefore includes the typical situation where a rig is above a wellhead, and the well extends down from the wellhead into the formation, but also horizontal wells where the formation may not necessarily be below the wellhead. Similarly 'work string' refers to any elongate member (such as a wire or cable) or tubular arrangement for conveying fluids and/or tools from a surface into a wellbore. In the present invention, slickline is the preferred work string.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention. Additionally, any feature disclosed in the specification can be combined alone or collectively with other features in the specification to form an invention.

Various embodiments and aspects of the invention will now be described in detail with reference to the accompanying figures. Still other aspects, features and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature and not as restrictive. Furthermore, the terminology and phraseology used herein is solely used for descriptive purposes and should not be construed as limiting in scope. Language such as "including" "comprising", "having", "containing" or "involving" and variations thereof, is intended to be broad and encompass the subject matter listed thereafter, equivalents and additional subject matter not recited, and is not intended to exclude other additives, components, integers or steps. In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein including (without limitations) components of the apparatus described herein are understood to include plural forms thereof and vice versa.

BRIEF DESCRIPTION OF AND INTRODUCTION TO THE DRAWINGS

Embodiments of the present invention will now be described, by way of example only and with reference to the accompanying drawings, in which:

FIG. 1 is a perspective side view of a guillotine bottom hole assembly (BHA) 100 and which, in use, will be attached at its upper most end to the lower most end of a work string such as a wireline which is preferably a slickline and which can be run into a wellbore in the running in configuration shown in FIG. 1, the guillotine BHA consisting of from top to bottom a:

power control module (PCM) and a linear actuator tool 106;

anchor tool 105;

hydraulic actuator tool 104;

indexer tool 103;

guillotine tool 102; and bull nose tool 101.

Figure 1:
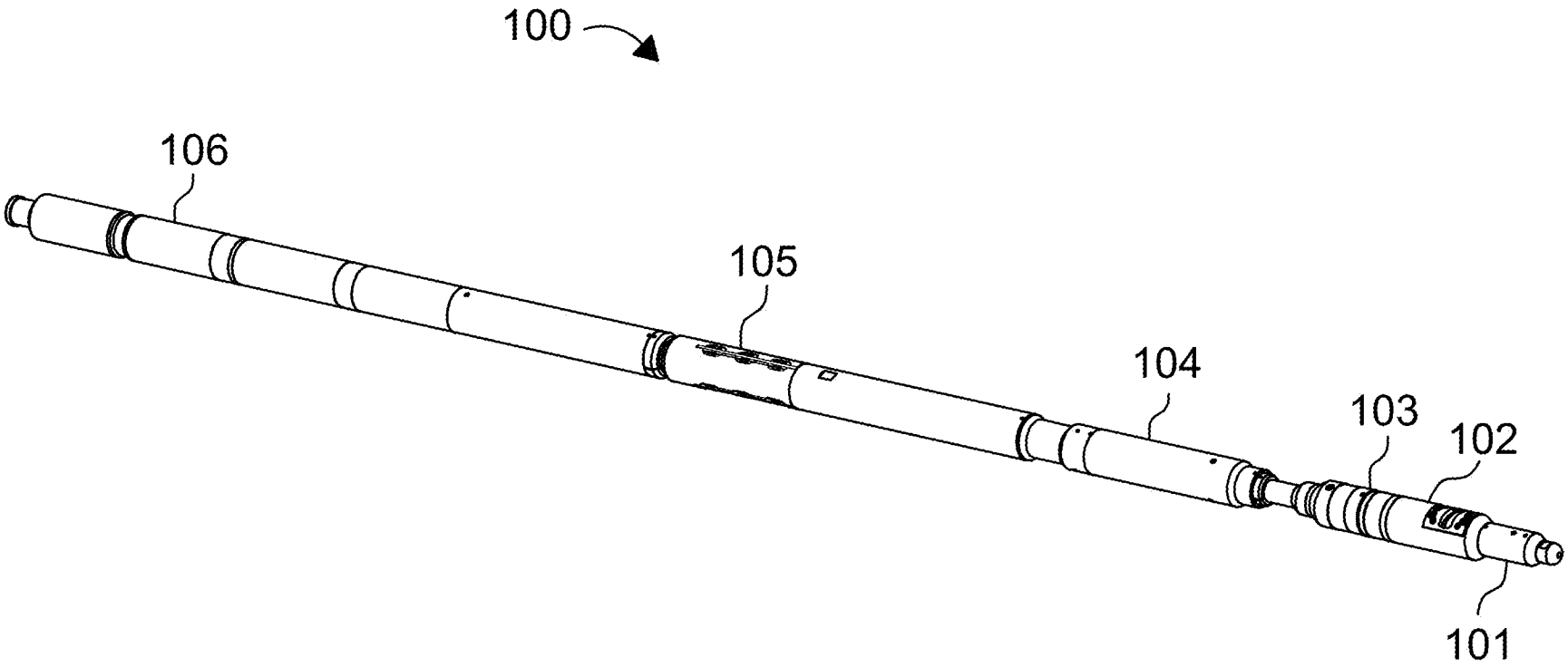
Figure 2:
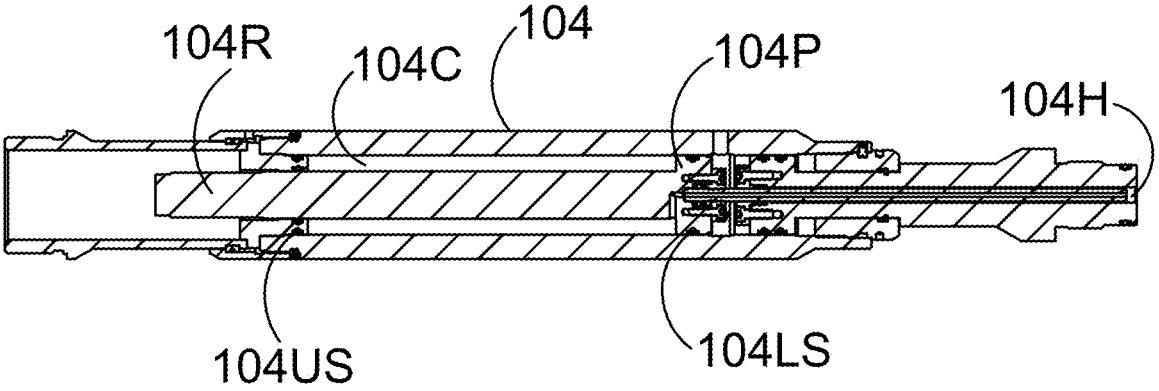
FIG. 2 is a cross-sectional side view of the linear actuator tool 104 shown in FIG. 1.
Figure 3:
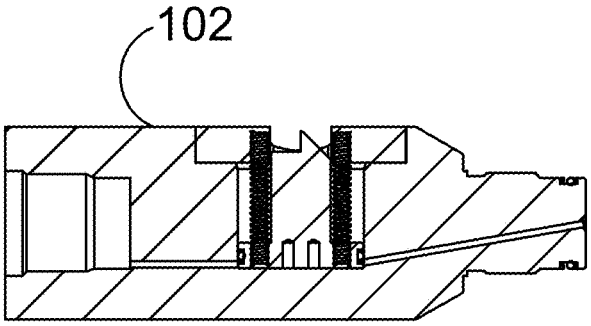
FIG. 3 is a cross-sectional side view of the guillotine tool 102 of FIG. 1.
Figure 5:
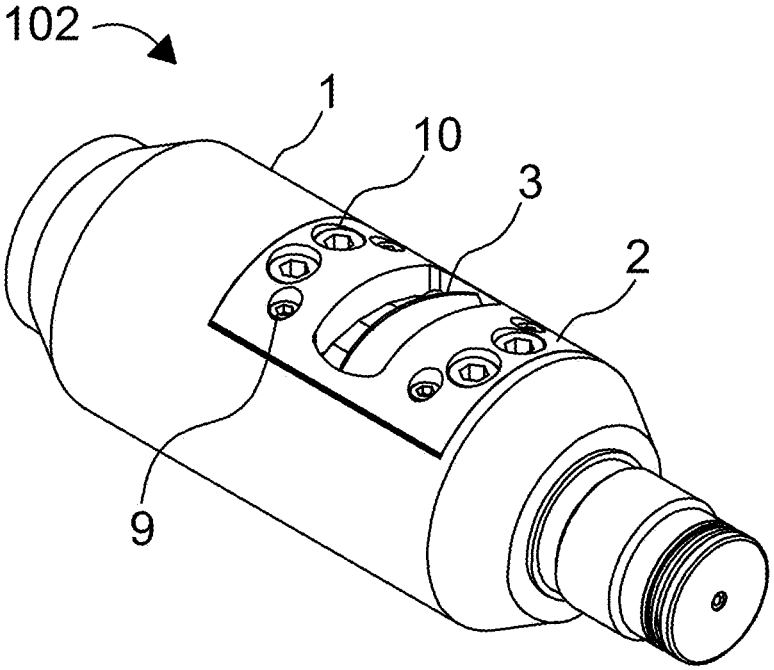
Figure 6:
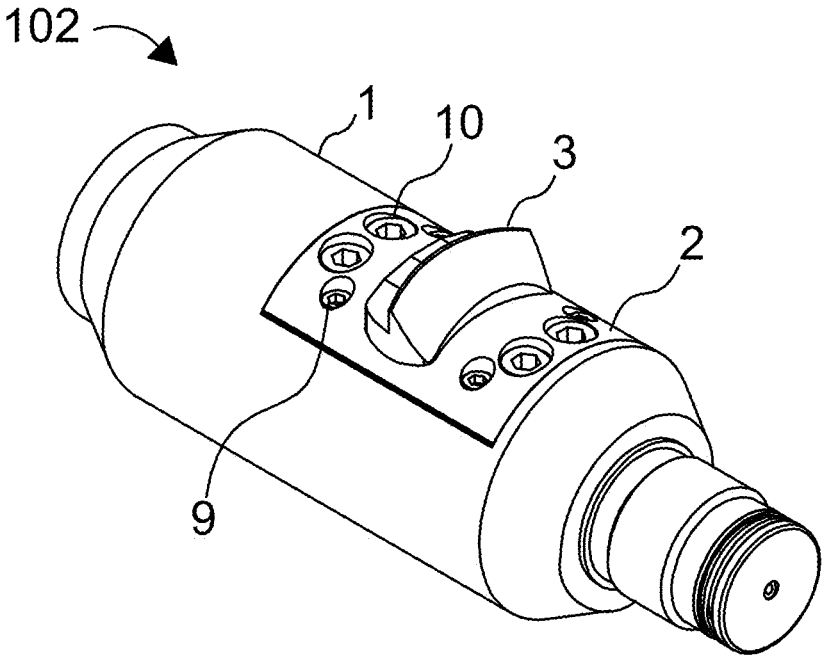
Figure 7:
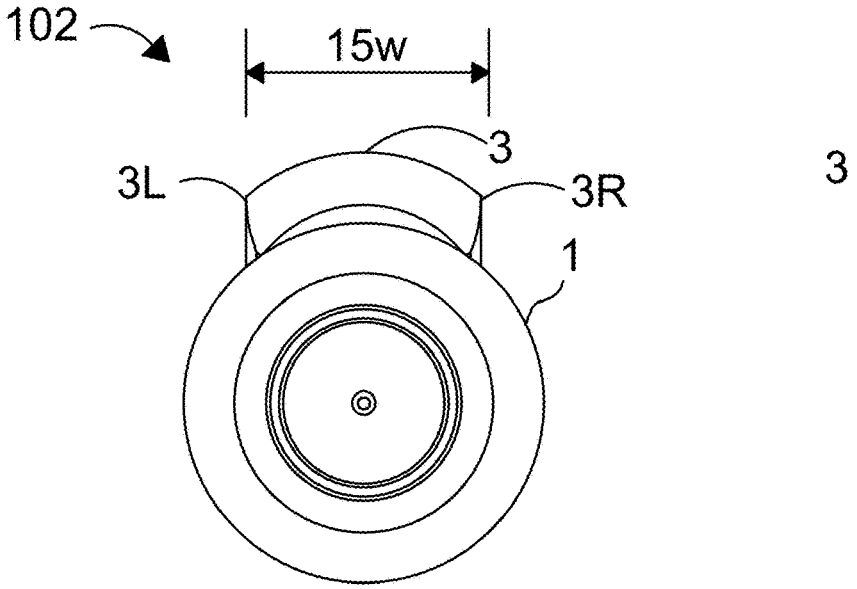
Figure 8:
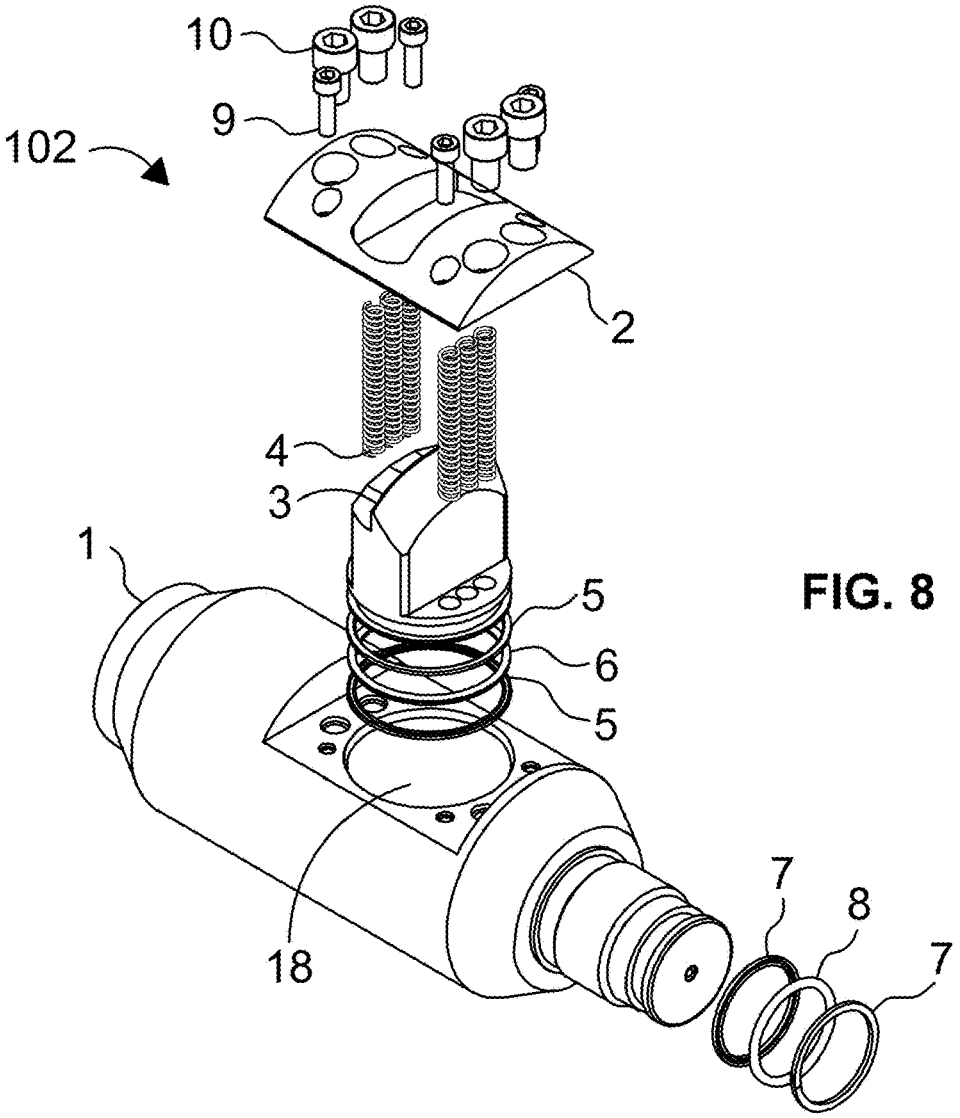
Figure 9:
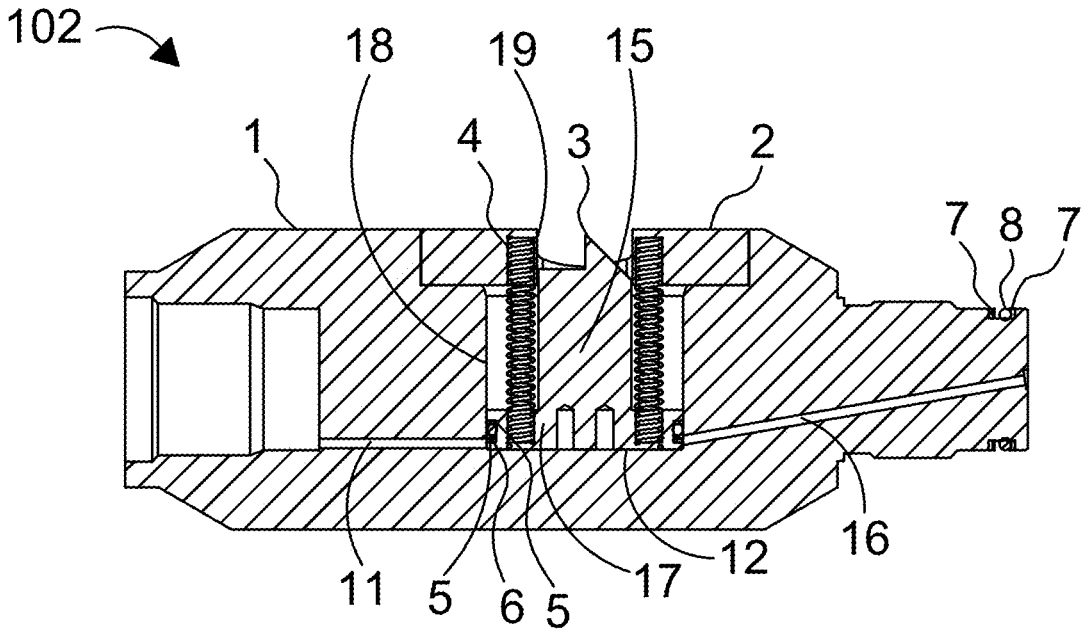
Figure 10:
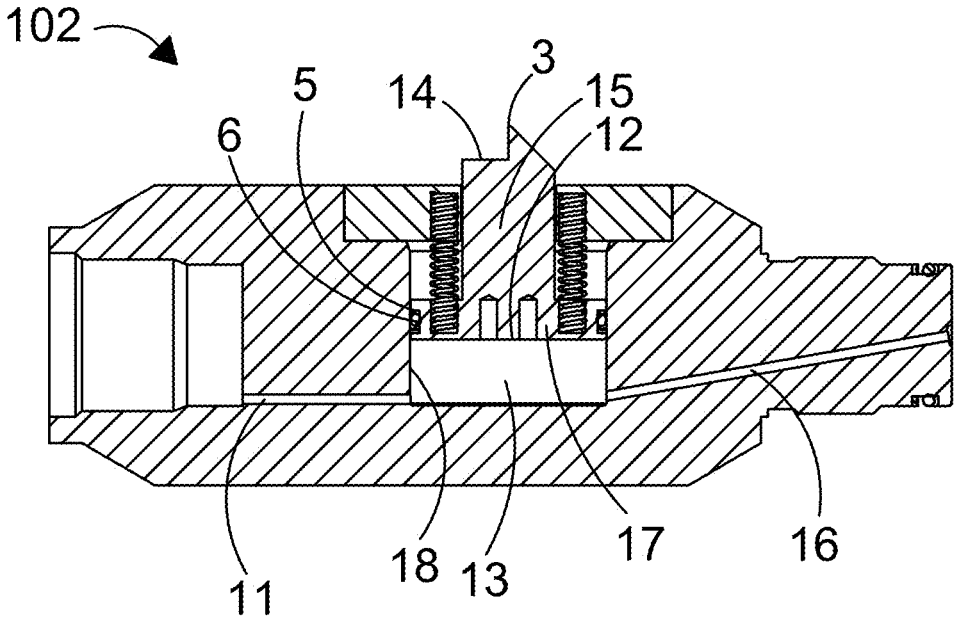
Figure 11:
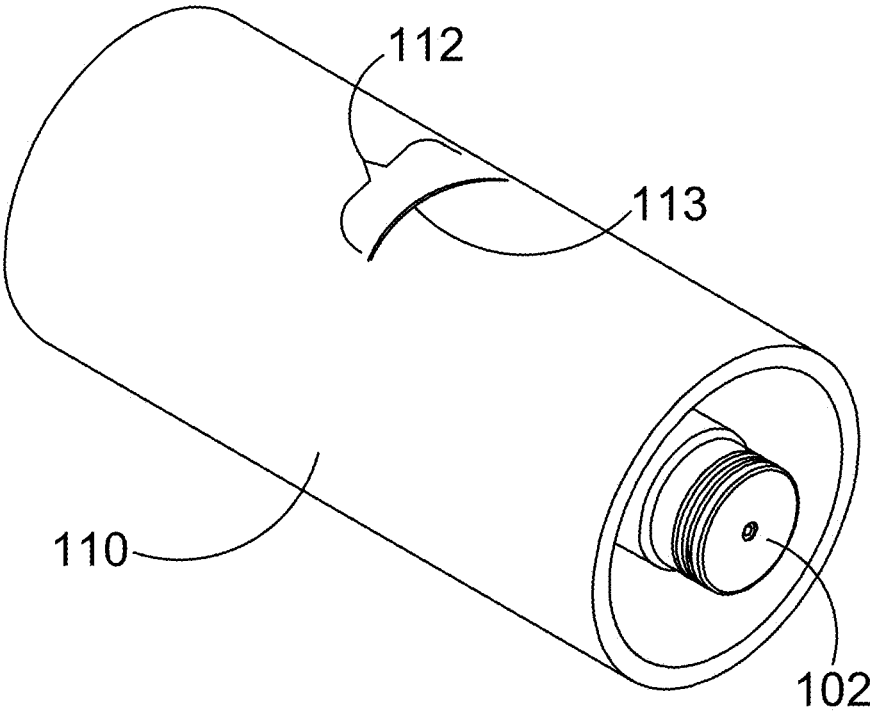
Figure 12:
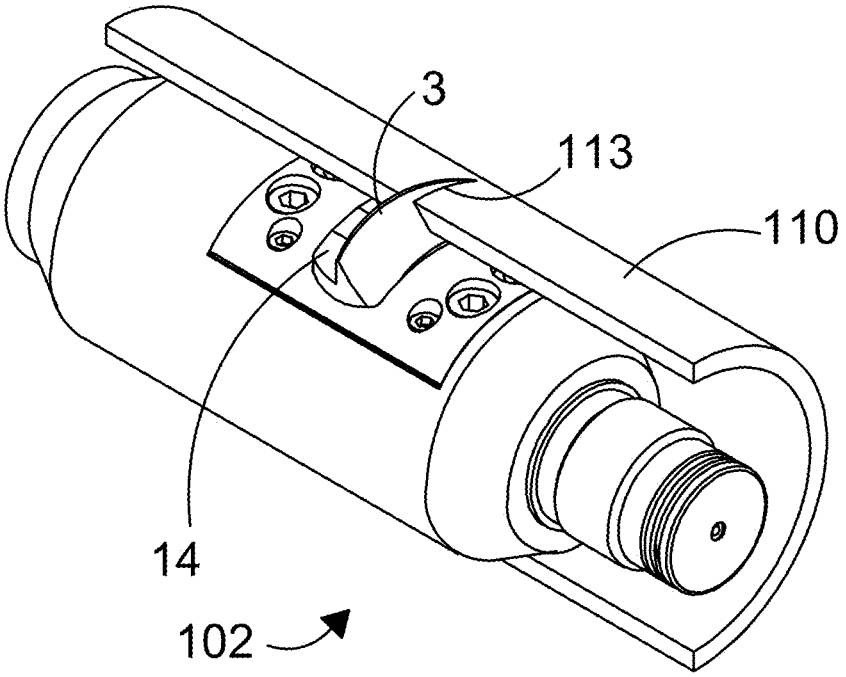
Figure 13:
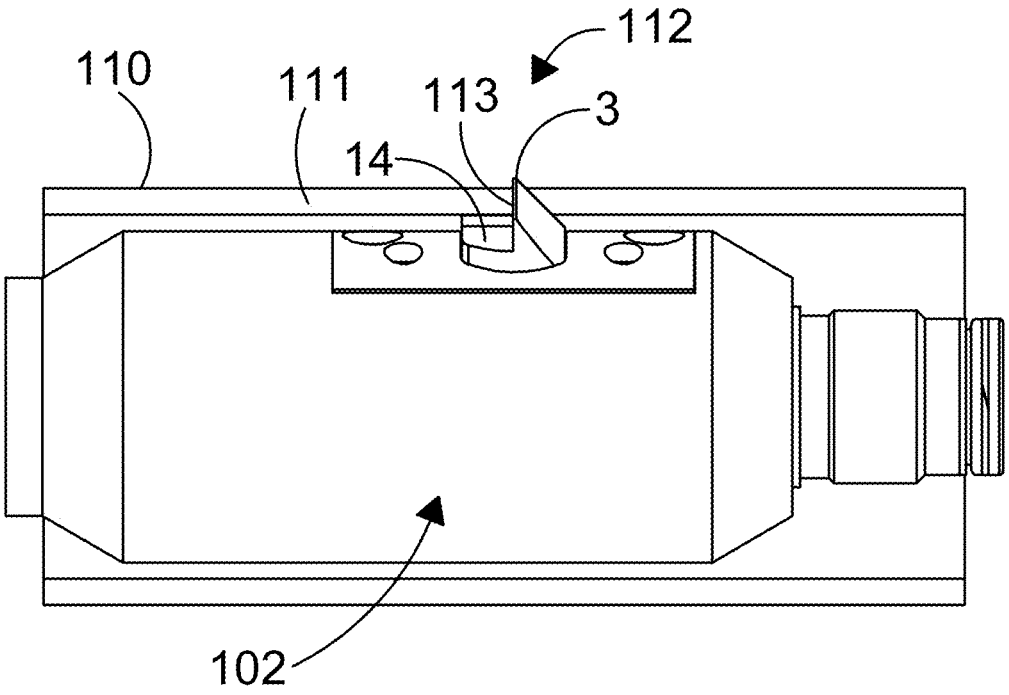
Figure 14:
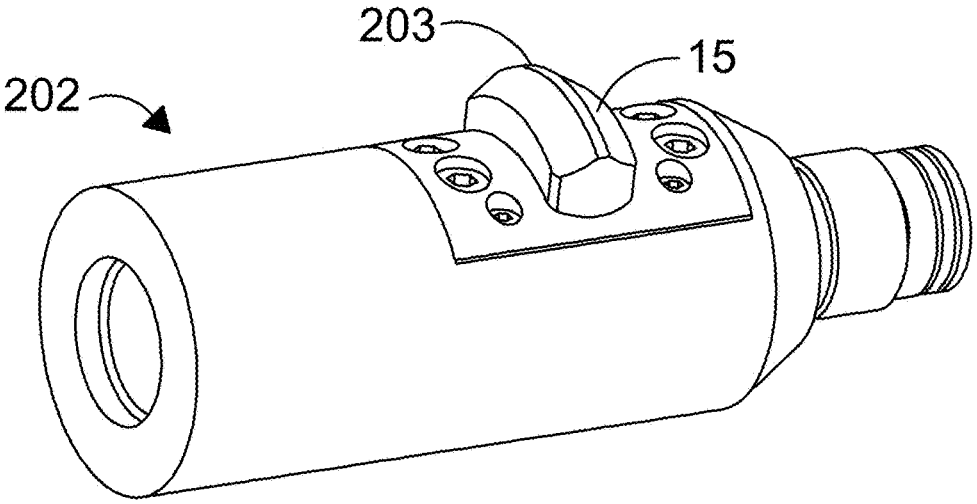
Figure 15A:
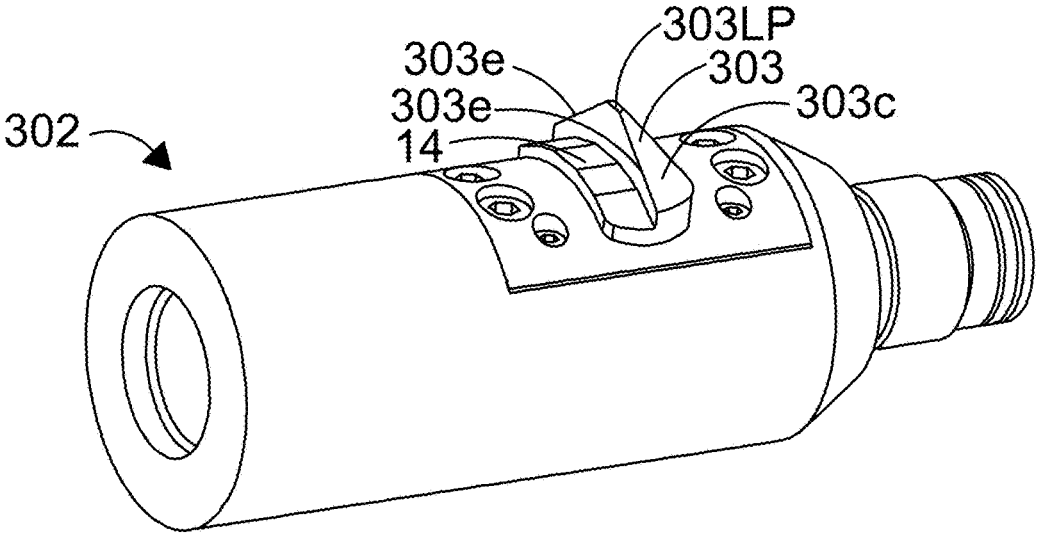
Figure 15B:
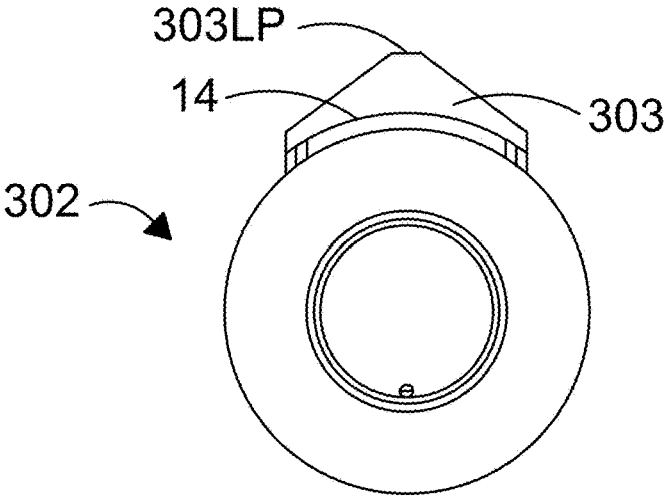

FIG. 5 is a perspective side view of the guillotine tool 102 of FIG. 1 and FIG. 3, where the guillotine tool 102 is shown in a running in configuration (where the guillotine cutting blade 3 is in a radially retracted position);

FIG. 6 is a perspective side view of the guillotine tool 102 of FIGS. 1 and 3 but is now shown with the guillotine cutting blade 3 in a radially extended (cutting) position;

FIG. 7 is an end view of the guillotine tool 102 of FIG. 6 also showing the guillotine cutting blade 3 in the radially extended (cutting) position;

FIG. 8 is an exploded perspective side view of the guillotine tool of FIGS. 1 and 3 where the components are only shown in an exploded configuration for ease of understanding of a skilled person;

FIG. 9 is a cross-sectional side view of the guillotine tool of FIGS. 1 and 3 showing the guillotine tool 102 in more detail and also showing the guillotine cutting blade 3 being in the radially retracted configuration;

FIG. 10 is a cross-sectional side view of the guillotine tool of FIGS. 1 and 3 but where the guillotine cutting blade 3 is now shown in the radially extended (cutting) position for cutting through the sidewall 111 of a downhole tubular 110 such as a production tubing string;

FIG. 11 is a perspective side view of the guillotine tool 102 being shown located within a downhole tubular 110 such as a production tubing string 110 where the guillotine cutting blade 3 has cut through a part circular section 112 of the sidewall 111 of the production tubing string 110;

FIG. 12 is a perspective side view of the guillotine tool 102 of FIG. 11 but where half of the production tubing 110 has been cut away for ease of understanding of the skilled person;

FIG. 13 is a side view of the part cut away production tubing 110 of FIG. 12 with the guillotine tool 102 being located therein and having formed a cut 113 through a part circular section 112 of the production tubing string 110;

FIG. 14 is a second embodiment of a guillotine tool 202 and which can be used in the guillotine bottom hole assembly 100 instead of the first embodiment of guillotine tool 102 where the second embodiment of guillotine tool 202 comprises a guillotine deformation blade 203 (instead of the guillotine cutting blade 3 as provided in the first embodiment of the guillotine tool 102) and can be used to deform a downhole tubular 110 (instead of cutting the downhole tubular 110 as with the use of the first embodiment of the guillotine tool 102);

FIG. 15*a* shows a third embodiment of a guillotine tool 302 and which can be used within the guillotine BHA 100 instead of the guillotine tool 102, where the guillotine tool 302 comprises a different shape and form of a guillotine cutting blade 303 compared with the guillotine cutting blade 3 of the first embodiment of guillotine tool 102, and where the guillotine cutting blade 303 is shown in the radially extended (cutting) position; and FIG. 15*b* shows an end view of the third embodiment of guillotine tool 302 where the guillotine cutting blade 303 is also shown in the radially extended (cutting) position.

DETAILED DESCRIPTION OF THE EMBODIMENTS OF PRESENT INVENTION

FIG. 1 shows a guillotine bottom hole assembly (BHA) 100, where the upper end of the guillotine BHA 100 is shown at the left hand side and will typically be attached to the lower end of a work string such as the preferred work string of slickline (not shown). The guillotine BHA 100 is arranged, in use, to be run into a wellbore (not shown) through the throughbore of a downhole tubular 110 such as a production tubing string 110 in the running in configuration as shown in FIG. 1.

The guillotine BHA 100 comprises, from top to bottom (left to right as shown in FIG. 1):

a suitable power control module (PCM) containing a suitable power source such as one or more battery packs and a linear actuator tool which, when powered by the PCM, will force a rod or piston linearly upwards or downwards as required (in this example, upwards) to provide a motive force to at least one or more than one of the tools located below it in the guillotine BHA 100. The PCM and linear actuator tool 106 can be any suitable PCM and linear actuator tool 106 such as a K-Set™ tool offered by Kaseum Technology Limited of Exploration Drive, Aberdeen, UK and/or as described in Patent Publication No WO2019/180462;

the upper end of an anchor tool 105 is attached to the lower end of the PCM and linear actuator tool 106, where the anchor tool 105 can be actuated by the PCM and linear actuator tool 106 (when required) to move a set of anchors radially outwards to grip against and thus anchor both the anchor tool 105 and the rest of the guillotine BHA 100 against the inner surface of the downhole tubular 110 which will subsequently either be deformed or cut as required. Any suitable anchor tool 105 can be used. One example of a suitable anchor tool 105 is the "K-FISH™" anchor tool offered by Kaseum Technology Limited of Exploration Drive, Aberdeen, UK. It should be noted however that the anchor tool 105 may in some circumstances not be required to be included in the guillotine BHA 100 if anchoring is not actually required by the operator;

the upper end of a hydraulic actuator tool 104 is securely attached to the lower end of the anchor tool 105, where the hydraulic actuator tool 104 is also actuated by the PCM and linear actuator tool 106 in that it also has the rod 104R passing through it from the lower end of the PCM and linear actuator tool 106, where the rod 104R when it moves upwards through the hydraulic actuator tool 104, pressures up hydraulic fluid contained within an annular chamber 104C (which is provided coaxially between the inner surface of the outer housing of the hydraulic actuator tool 104 and the outer surface of the rod 104R and is further bounded between an upper seal 104US and a piston 104P having a lower seal 104LS provided at the lower end of the rod 104R) to a very high pressure such as in the region of 10,000 to 30,000 psi (68.95-206.84 MPa) and particularly in the region of 15,000 to 16,000 psi (103.42-110.32 MPa) and, when required, the hydraulic actuator tool 104 supplies that very high pressure hydraulic fluid to the guillotine tool 102 through a central hydraulic fluid conduit 104H as will be described subsequently.

the upper end of an indexer tool 103 is securely connected to the lower end of the hydraulic actuator tool 104, where the indexer tool 103 can be actuated by means of the supply of the high pressure hydraulic fluid from the hydraulic actuator tool 104 to rotate the guillotine tool 102 (which is connected at its lower end) in accordance with the present invention through a particular angle of rotation such as 30°, 60° or 90° as required by the operator and as pre-determined by the operator; in the present embodiment, 60° is preferred such that 6 rotations of the indexer tool 103 will be required in order to rotate the guillotine tool 102 through 360° (as will be described in detail subsequently). Any suitable indexer tool 103 could be used but two examples of which are as follows:

a Hydraulic Indexing Tool as offered by TOMS and Interenergy, Inc. (also known as Ties, Inc.) of 15902 Hollister Street, Houston, Texas 77066, USA; or a high torque indexing tool as offered by Downhole Tools International of 2 Allens Lane, Poole, BH16 5DA, United Kingdom;

the upper end of a guillotine tool 102 in accordance with the present invention is attached to the lower end of the indexer tool 103, where the guillotine tool 102 will, as will be described subsequently, be actuated by means of the high pressure hydraulic fluid delivered from the hydraulic actuator tool 104 to force a guillotine cutting blade 3 readily outwards to cut through a part circular section 112 of the sidewall 111 of a downhole tubular such as production tubing 110;

the upper end of a bull nose tool 101 is securely connected to the lower end of the guillotine tool 102, where the bull nose tool 101 in use directs and guides the lower end of the guillotine BHA 100 into and through the through bore of the downhole tubular 110 as it is being run in and also serves to provide a release of high pressure hydraulic fluid should that be required when the guillotine BHA 100 is being pulled out of the wellbore, as will be described in more detail subsequently.

The guillotine tool 102 comprises a generally cylindrical 1. As shown particularly in FIG. 9, a guillotine body 15 is located within a cylindrical recess formed radially into the housing 1 at its approximate mid-point, where the guillotine body 15 has the guillotine blade 3 formed on its outer most surface and where a flange 17 is formed at the inner most end of the guillotine body 15 (advantageously maximising the potential stroke of the guillotine body 15 between retracted and extended positions), the flange 17 being circular and having a greater diameter than the axial width of the guillotine body 15. A (primary) slidable O-ring 6 is provided around the outer circumference of the flange 17 such that the O-ring 6 seals against the inner surface of the cylindrical recess 18. O-ring back ups 5 are further provided in order to prevent extrusion of the primary O-ring 6. A retainer plate 2 is secured around the outer end of the cylindrical recess 18 by a suitable securing means such as cap screws 9, 10 or the like where the retainer plate 2 comprises an aperture 19 formed around its mid-point where the aperture 19 is sufficiently wide (i.e. it comprises an axial width which is wider than the axial width of the guillotine body 15) so as to allow the guillotine blade 3 and the main part of the guillotine body 15 to pass there through when the guillotine tool 102 is actuated to radially extend the guillotine blade 3 outwards but is sufficiently narrow (i.e. its axial width is less than the diameter of the flange 17) so as to prevent the flange 17 from passing there through and therefore the retainer plate 2 acts to retain at least the flange 17 of the guillotine body 15 within the cylindrical recess 18 at all times.

The guillotine body 15 is biased into the retracted position shown in FIG. 9 by a suitable biasing means such as a set of compression springs 4 which act between the inner surface of the retainer plate 2 and the outermost face of the flange 17. Thus, for the guillotine blade 3 to be radially extended outwards, the guillotine body 15 must be moved outwards against the spring force provided by the springs 4. Thus, the springs 4 will assist in retracting the guillotine body 15 back into the retracted position shown in FIG. 9 when required, as will be described subsequently.

The guillotine tool 102 is arranged such that when high pressure hydraulic fluid such as in the region of 10,000-30,000 psi (68.95-206.84 MPa) and particularly in the region of 15,000-16,000 psi (103.42-110.32 MPa) is supplied from the hydraulic actuator tool 104 into the fluid port 11, the high pressure hydraulic fluid will act against the inner piston face 12 (particularly due to the O-ring seals 5, 6) and continued supply of high pressure hydraulic fluid through the fluid port 11 will start to accumulate within hydraulic fluid chamber 13, thus forcing the inner piston face 12 and thus the flange 17 and thus the guillotine body 15 and thus the guillotine blade 3 radially outwards such that it moves from the retracted position shown in FIG. 9 to the radially extended position shown in FIG. 10. Continued pumping of high pressure hydraulic fluid into the fluid port 11 will continue to move the guillotine body 15 radially outwards until the outer most face of the flange 17 abuts against the inner face of the retainer plate 2 at which point the retainer plate 2 prevents any further outward movement of the guillotine body 15.

Withdrawal of high pressure hydraulic fluid from the hydraulic fluid chamber 13 will thus allow the guillotine body 15 to be moved radially inwards from the extended position shown in FIG. 10 back into the retracted position shown in FIG. 9. This is typically achieved by actuating the hydraulic actuator tool 104 to withdraw the fluid in the hydraulic fluid chamber 13 back through the fluid port 11 (and through the central hydraulic fluid conduit 104H and back into the annular chamber 104C within the hydraulic actuator tool 104). Having fluid both introduced and withdrawn into/from the single hydraulic fluid chamber 13 through the same fluid port 11 advantageously simplifies the guillotine tool 102 by providing an apparatus that only requires a single fluid chamber 13 and piston face 12 to both extend and retract the guillotine body 15, Additionally, this maximises the stroke available to move the guillotine body 15 versus the overall outer diameter of the guillotine BHA 100). The springs 4 will assist in the radially inwards movement of the guillotine body 15 as will hydrostatic pressure provided by the wellbore fluid outside of the guillotine BHA 100 because that will act upon the radially outer most face of the flange 17, particularly when the hydrostatic pressure is greater than the pressure of the hydraulic fluid within the hydraulic fluid chamber 13.

The annular chamber 104C of the hydraulic actuator tool may be considered a further fluid reservoir 104C separate to and in fluid communication with the fluid chamber 13 of the guillotine tool 102. The skilled person would understand that the fluid reservoir 104C of the hydraulic actuator tool 104, the fluid chamber 13 of the guillotine tool 102 and components connected therebetween make up a closed system having a fixed volume (and therefore a fixed volume of fluid such as substantially non-compressible hydraulic fluid contained therein) such that there is no exchange of fluid between the closed system and its surroundings in operation (i.e. moving the guillotine body either radially inwards or radially outwards). In particular, fluid is neither released from nor introduced into the closed system during operation.

Figure 4:
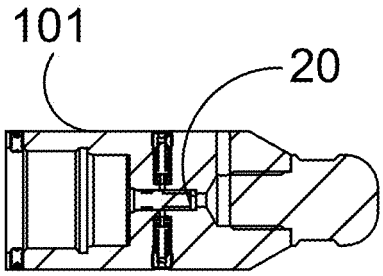
FIG. 4 is a cross-sectional side view of the bull nose tool 101 of FIG. 1.

A hydraulic fluid outlet 16 is provided within the guillotine tool 102 and which leads from the lower end of the hydraulic fluid chamber 13 to the lower end of the guillotine tool 102 and which can deliver hydraulic fluid to the bull nose tool 101 located immediately below the guillotine tool 102. The bull nose tool 101 will simply retain the hydraulic fluid supplied to it and will not usually interfere with the operation of the guillotine tool 102 nor the guillotine BHA 100. However, a hydraulic fluid release mechanism is provided within the bull nose tool 101 where that hydraulic fluid release mechanism could comprise a burst disc 20 (shown in FIG. 4) which will burst (when the differential pressure across it exceeds a predetermined level, such as 25,000 psi (172.37 MPa)) and will therefore release the high pressure hydraulic fluid if for example the guillotine BHA 100 still contains some high pressure hydraulic fluid located within for example the hydraulic fluid chamber 13 when the guillotine BHA 100 is being pulled out of the hole and this ensures that the guillotine BHA 100 cannot return to the surface still containing high pressure hydraulic fluid within itself (which could be a danger to personnel at the surface if the high pressure hydraulic fluid was still present). Alternatively, instead of a burst disc 20, the bull nose tool 101 could contain for example a hydraulic fluid check valve (not shown) which allows the high pressure hydraulic fluid to pass through the check valve if there is a significantly high pressure differential located within the hydraulic fluid compared to the external environment. The hydraulic fluid release mechanism can also operate to release high pressure hydraulic fluid that has been inadvertently built up in the unlikely event that the hydraulic actuator tool 104 is operated for a longer period than intended by the PCM and linear actuator tool 106.

The skilled person will further understand that by withdrawing the high pressure hydraulic fluid from the hydraulic fluid chamber 13, that action is akin to attempting to pull a vacuum within the hydraulic fluid chamber 13 and therefore that action will force and pull the guillotine body 15 from its radially extended position shown in FIG. 10 to the radially retracted position shown in FIG. 9.

The guillotine tool 102 is further provided with a (primary) O-ring 8 at its lower end which seals against the inner surface of the upper end of the bull nose tool 101 and is further provided with O-ring back ups 7 in order to prevent extrusion of the primary O-ring 8.

As shown in the first embodiment of the guillotine tool 102 in for example FIGS. 5 and 6, the guillotine cutting blade 3 has a certain circumferential width (i.e. the width between the two ends 3L, 3R of the arc length circumscribed by the cutting blade 3) and that the circumferential width between the ends 3L, 3R is the same as the circumferential width 15W of the guillotine body 15. Furthermore, as particularly can be seen in FIG. 6 and FIG. 7, the outermost cutting surface of the guillotine blade 3 is provided with a radius such that the guillotine blade 3 is part circular. In the embodiment of the guillotine tool 102 shown in FIG. 6, the guillotine blade 3 extends between ends 3L, 3R through an arc of 60°, such that when the guillotine tool 102 is actuated to extend the guillotine blade 3 radially outwards to the position shown in FIG. 6 and particularly as shown in FIG. 7 and FIGS. 10-13, the guillotine cutting blade 3 will therefore cut through a 60 degree arc circumferentially around the sidewall of the downhole tubular 110 such as the production tubing string 110 in order to form one part circular cut section of the sidewall 112 therein.

Moreover, whilst it is preferred that the outer surface of the guillotine cutting blade 3 is part circular with a uniform radius and furthermore it is preferred that the uniform radius matches the radius of the inner surface of the downhole tubular 110 to be cut (in order that the entire cutting surface of the guillotine blade 3 meets the inner surface of the throughbore of the downhole tubular 110 simultaneously such that a uniform cut is formed through the sidewall 112), it may be that other embodiments have a different form or shape of guillotine cutting blade and indeed in some embodiments it could be that the outer surface of the guillotine cutting blade 3 is not radiused and indeed could be a planer surface such that when it is extended into the extended position shown in FIG. 10, the outer most edges (i.e. those equivalent to 3L, 3R) of the planer guillotine blade (not shown) meet the inner surface of the throughbore of the downhole tubular 110 at two spaced apart points and further extension radially outwards of the guillotine body 15 results in the two end cutting points of contact being moved closer together until the whole length of the planer guillotine cutting blade has pierced through the sidewall of the downhole tubular. It is preferred however that the outer surface of the guillotine cutting blade 3 is part circular with a constant radius and it is most preferred that that constant radius matches the inner radius of the downhole tubular to be cut such that the guillotine body 15 has the least amount of travel required in order to fully cut through the sidewall 112 of the downhole tubular 110.

The radial length of the guillotine body 15 is sufficiently long and the guillotine body 15 is arranged such that it can be extended radially outwardly by a sufficient extent when required to perform a cut such that it can extend outwards:

- to firstly close the annular gap between the outer cutting surface of the guillotine blade 3 and the inner surface of the downhole tubular 110 such as the production tubing string 110; and
- secondly move the whole arc length (i.e. the whole length between the ends 3L, 3R) of the outer cutting surface of the guillotine blade 3 through the entire depth of the sidewall 111 of the downhole tubular 110 such as the production tubing string 110 such that the guillotine blade 3 cuts through the entire depth of the sidewall 111 of a part circular section of the sidewall 112 (and in this example the part circular section of the sidewall 112 extends in a 60 degree arc around the circumference of the production tubing string 110).

The skilled person will understand that the entire length between the ends 3L, 3R of the outer cutting surface of the guillotine blade 3 need not all lie on the same part circumferential plane in that a non-part circumferential cutting edge could be provided (such as a sine wave (not shown) or triangular cutting teeth shape (not shown) etc.) but it is important that the ends 3L, 3R of the outer cutting surface of the guillotine blade 3 lie on or coincide with the same part circumferential plane, such that when the guillotine tool 102 is rotated by operation of the indexer tool 103 (as will be described subsequently), one of the ends (e.g. 3L) will be aligned with the end of the cut immediately previously formed through the part circular section of the sidewall 112 by the other end (e.g. 3R) such that when the guillotine body 15 is next extended radially outwardly, it cuts through a further 60 degree part circular section of the sidewall which immediately adjoins the previously formed 60 degree part circular section of the sidewall 112 and therefore there is now formed a cut through 120° of part circular section of the sidewall 112 (and so on). It is preferred however that the entire length including the ends 3L, 3R of the outer cutting surface of the guillotine cutting blade 3 all lie on/are coincident with the same part circumferential plane as that which provides the shortest length of cut possible.

It should also be noted that whilst there are only one guillotine body 15 and therefore one guillotine cutting blade 3 per guillotine tool 102 as shown in the figures, the skilled person will understand that modifications and/or improvements could be made to the embodiments hereinbefore described such as by providing two or more guillotine bodies 15 located within their respective cylindrical recesses 18 in order to provide multiple guillotine cutting blades 3 per guillotine tool 102; in such a case it is preferred that the respective guillotine body 15 would be spaced around the housing 1 within respective cylindrical recesses 18 such that the respective cutting blades 3 would all lie on the same cylindrical plane and would be spaced apart by a multiple (e.g. 1, 2 or 3) of the circumferential width 15W such that rotation of the guillotine tool 102 by the indexer tool 103 by e.g. a predetermined rotational arc such as 60° results in each of the plurality of guillotine blades 3 rotating around and aligning with the next part circular section of the sidewall 112 to be cut and which also result in fewer rotations by the indexer tool 103 being required.

The arc length of the guillotine blade 3 (i.e. the circumferential distance between the ends 3L, 3R) can be any suitable arc length but is greater than 18° in order to make the number of rotations of the guillotine tool 102 by the indexer tool 103 and the number of radial deformations and retractions of the guillotine body 15 viable within the power constraints of the energy provided by the batteries of the PCM and to keep the time required for a full 360 degree cut around the whole circumference of the sidewall 111 to a minimum, being greater than 18° means that less than 20 rotations of the guillotine tool 102 will be required for the full 360° cut. In preferred embodiments, the said arc length is in the range of from 20° to 180° (to require 18 or 2 rotations respectively) and in even more preferred embodiments is in the range of from 30° to 90° (to require 12 or 4 rotations respectively) and even more preferably from 45° (8 rotations) to 72° (5 rotations) and in the most preferred embodiment as shown in FIGS. 1 to 15*b*, the said arc length is in the region of 60° in order to require only 6 rotations of the guillotine tool 102 by the indexer tool 103 as that provides the best compromise between being able to cut the maximum circumference of the side wall 111 with each cut or deformation in the shortest amount of time and using the least amount of energy from the set of batteries in the PCM and linear actuator tool 106.

Method of Performing A 360° Cut Through the Sidewall 111 of A Downhole Tubular 110

The guillotine BHA 100 is run into the wellbore typically through the through bore of the downhole tubular 110 which is to be cut in two, such as a production tubing string 110. The guillotine BHA 100 is run in until the guillotine tool 102 and in particular the guillotine blade 3 reaches the depth location at which the downhole tubular 110 requires to be cut in two. The guillotine BHA 100 is halted at that point by arresting the running of the slickline unit (not shown) at the surface.

The PCM and linear actuator tool 106 can then be actuated typically either by wireless instruction or by waiting for a timer on board the PCM to expire thus instructing the PCM to operate the linear actuator tool 106 which in turn actuates the anchor tool 105 (if present) to set against the inner surface of the throughbore of the downhole tubular 110. Continued actuation of the linear actuator tool 106 by the PCM will cause the hydraulic actuator tool 104 to provide high pressure hydraulic fluid into the fluid port 11 of the guillotine tool 102 thus forcing the guillotine body 15 and the guillotine blade 3 radially outwards to pierce the 60 degree arc of the sidewall 111 of the downhole tubular 110 to thereby form a cut through one part circular section 112 of the sidewall 111. It should be noted that the guillotine body 15 will continue to move radially outwards to move the guillotine cutting blade 3 through the sidewall 111 of the downhole tubular 110 until the guillotine cutting blade 3 has fully pierced through the sidewall 111. An abutment face 14 is provided at one side of the guillotine cutting blade 3 and is arranged to abut against the inner surface of the throughbore of one half (e.g. the upper half) of the downhole tubular 110 thus arresting the radially outward movement of the guillotine body 15 and that helps ensure that the guillotine body 15 is not over extended outwards and thus does not move too far outwards and this assists in preventing jamming of the guillotine body 15 with/within the sidewall 111 of the downhole tubular 110.

The PCM can then be actuated to withdraw the hydraulic fluid from the hydraulic fluid chamber 13 and thus pull the guillotine body 15 radially inwardly such that it retracts from the extended configuration position shown in FIG. 10 to the retracted position shown in FIG. 9.

Once the guillotine body 15 has moved radially inwards fully back into the retracted position shown in FIG. 9, the PCM and linear actuator tool 106 can actuate the indexer tool 103 to rotate the guillotine tool 102 by a predetermined amount such as by the same arc length of the guillotine blade 3 (e.g. the arc length between the ends 3L, 3R) which in this example is 60°. Once the indexer tool 103 has rotated the guillotine tool 102 by that predetermined amount (which preferably matches the circumferential extent of the arc provided by the guillotine cutting blade 3) the PCM and linear actuator tool 106 can then again actuate the hydraulic actuator tool 104 to supply high pressure hydraulic fluid into the fluid port 11 and thus repeat the cutting of the next 60 degree arc of the sidewall 111 (i.e. the next part circular section 112 of the sidewall 111) of the downhole tubular 110 by the guillotine cutting blade 3. The actuation of the indexer tool 103 can follow once more and the process can be repeated until the guillotine tool 102 has been rotated 5 times (i.e. through) 300° and the guillotine cutting blade 3 has been extended the required number of times (i.e. 6 times) to cut through 360° of part circular sections 112 of the sidewall 111 of the downhole tubular 110. Furthermore, because the slickline has been kept locked at the same vertical height, the guillotine tool 102 ensures that the 60 degree cut through the part circular section 112 of the sidewall 111 is formed around the circumference of the downhole tubular 110 at exactly the same height/axial location and if present the anchor tool 105 further ensures that the individual cuts through the part circular sections 112 of the sidewall 111 are made at the same vertical height within the well thus ensuring that the downhole tubular 110 is cut cleanly in two to form an upper downhole tubular section and a lower downhole tubular section. Once the final (sixth) cut has been made, the anchor 105 can be unset and the guillotine BHA 100 can be pulled out of the well bore thus leaving the cut downhole tubular 110 within the well and therefore the upper section of the cut downhole tubular 110 can be pulled out of the wellbore in a separate operation (if removal of the upper section of the cut downhole tubular 110 from the wellbore is required).

Embodiments of the present invention have a great advantage that they use significantly less power than prior art methods and thus can be operated on and run into the well bore on slickline and this provides significantly lower cost (possibly by an order of a whole magnitude) compared to existing prior art methods of cutting downhole tubulars.

FIG. 14 shows a second embodiment of a guillotine tool and which has a guillotine deformation blade 203 instead of the guillotine cutting blade 3 provided on the outer most surface of the guillotine body 15. In other words, instead of using the cutting edge provided by the guillotine cutting blade 3 to cut through the part circular sections 112 of the sidewall 111, the guillotine deformation blade 203 comprises a part circular but flat outer surface which will come into contact with the inner surface of the throughbore of the downhole tubular 110 and therefore instead of providing a point contact which will cut through the downhole tubular 110, the flat guillotine deformation blade 203 will act across a much greater surface area of the inner surface of the throughbore of the downhole tubular 110 and therefore instead of cutting through the downhole tubular 110 sidewall 111, it will act to deform the sidewall 111 of the downhole tubular 110 outwards. Accordingly, the second embodiment of the guillotine tool 202 can be used to deform a downhole tubular 110 (and hence will leave the sidewall 111 intact rather than cut through it) such as to deform it into contact with the wellbore located outside of the downhole tubular 110 or to deform the downhole tubular 110 into contact with a yet further outer downhole tubular 110.

FIG. 15*a* and FIG. 15*b* show a third embodiment of a guillotine tool 302 which comprises a guillotine cutting blade 303 and which comprises a leading point 303LP at the zenith of a part cone section 303C. Accordingly, when the guillotine cutting blade 303 of the third embodiment of guillotine tool 302 is placed within the guillotine BHA 100 (instead of the first embodiment of guillotine tool 102) and when the guillotine cutting blade 303 is forced radially outwards by the high pressure hydraulic fluid collecting within the hydraulic chamber 13, the leading point 303LP will make contact with the inner surface of the downhole tubular 110 and further radial deformation outwards of the guillotine cutting blade 303 will cause the cutting edges 303E to cut through the sidewall 111 of the downhole tubular 110 in a gradual action and therefore the third embodiment of the guillotine cutting blade 303 is more suited to applications where a greater distance of radial deformation is possible and where a more highly localised cutting action or force is required.

Further shapes and forms of guillotine cutting blades and guillotine deformation blades are within the possibility of design by the skilled person without departing from the scope of the invention.

Embodiments of the present invention have the greater advantage that they can be run on slickline and can be actuated and powered by a relatively low power source such as a set of batteries located in a downhole tool such as the PCM and can be operated to cut through a downhole tubular 110 such as a production string 110 and such embodiments will save considerable costs and time for operators.

Modifications and improvements may be made to the foregoing embodiments without departing from the scope of the invention.

The invention claimed is:

1. An apparatus for cutting through or deforming a sidewall of a downhole tubular, the apparatus comprising:

a housing having a cylinder provided therein:

at least one radially moveable body member having a contact surface formed on an outer surface thereof;

wherein the body member is located within and is radially moveable within the cylinder such that the contact surface is moveable between a retracted position and an extended position for at least contacting the inner surface of a throughbore of a downhole tubular, wherein the contact surface comprises an arc length which extends, from end to end, in the range of 45° and 72°;

wherein the body member comprises a piston;

wherein the housing comprises a fluid chamber defined by at least one inner surface of the cylinder and an innermost face of the piston;

wherein the housing further comprises a fluid port to permit fluid to flow into and out of said fluid chamber;

wherein the apparatus further comprises:— a separate fluid reservoir in fluid communication with said fluid chamber; and a hydraulic actuator tool configured to introduce fluid into the fluid chamber from said separate fluid reservoir and withdraw fluid from the fluid chamber into said separate fluid reservoir;

wherein, by operation of the hydraulic actuator tool, the body member is radially moveable from the retracted position to the extended position by introduction of fluid, from said separate fluid reservoir, through said fluid port and into said fluid chamber; and wherein, by operation of the hydraulic actuator tool, the body member is radially moveable from the extended position to the retracted position by withdrawal of fluid through said fluid port from said fluid chamber, through said fluid port and into said separate fluid reservoir; and wherein the apparatus has a longitudinal axis and is adapted to be rotated within the throughbore of the downhole tubular about said longitudinal axis such that the contact surface remains on the same circumferential plane.

2. The apparatus according to claim 1, wherein the body member is radially moveable outwards in order to move the contact surface into contact with the inner throughbore of the downhole tubular by introduction of fluid into the fluid chamber; and wherein the body member is radially moveable inwards in order to move the contact surface away from the inner throughbore of the downhole tubular by withdrawal of fluid from said fluid chamber.

3. The apparatus according to claim 1, wherein the ends of the contact surface coincide with the same part circumferential plane.

4. The apparatus according to claim 1, wherein the said ends of the contact surface comprise a first end point and a second end point, where the first and second end points are distinct from one another and are at opposite ends of the arc length from one another, and wherein all points on the arc length, including the two end points, are all coincident on the same plane.

5. The apparatus according to claim 1, wherein the arc length of the contact surface is 60°.

6. The apparatus according to claim 1, wherein the contact surface comprises a radius substantially the same as the radius of the downhole tubular to be contacted by the contact surface.

7. The apparatus according to claim 1, wherein the contact surface comprises a different radius to the radius of the downhole tubular to be contacted by the contact surface.

8. The apparatus according to claim 1, wherein the contact surface comprises a blade surface adapted to cut through the sidewall of the downhole tubular.

9. The apparatus according to claim 1, wherein the contact surface comprises a deformation surface adapted to deform the sidewall of the downhole tubular radially outwards.

10. The apparatus according to claim 1, wherein the apparatus is adapted to be rotated within the throughbore of the downhole tubular about the longitudinal axis by the same arc length as that of the contact surface.

11. The apparatus according to claim 1, wherein the apparatus is provided within a bottom hole assembly comprising a power supply within said bottom hole assembly.

12. The apparatus according to claim 1, wherein the apparatus is provided within a bottom hole assembly comprising an anchor assembly adapted to anchor the bottom hole assembly and thus the apparatus in axial position within the wellbore.

13. The apparatus according to claim 1, wherein the apparatus is adapted to be run into the throughbore of the downhole tubular to the required location downhole with the contact surface in the retracted position on a slickline.

14. The apparatus according to claim 1, wherein the body member comprises a biasing mechanism configured to bias the body member radially inwards.

15. The apparatus according to claim 1, wherein the apparatus is adapted to be rotated within the throughbore of the downhole tubular about the longitudinal axis of the apparatus by an indexer tool connected thereto.

16. The apparatus according to claim 1, wherein the contact surface is adapted to be wholly located within the apparatus when in the retracted position such that it does not extend further outwards from the apparatus than other portions of the apparatus.

17. The apparatus according to claim 1, wherein the apparatus is adapted to be rotated within the throughbore of the downhole tubular about the longitudinal axis of the apparatus whilst the contact surface is in the retracted position.

18. The apparatus according to claim 1, wherein said separate fluid reservoir, said fluid chamber and said fluid port, make up a closed system having a fixed volume of fluid therein, such that fluid is neither released from nor introduced into the closed system during operation.

19. The apparatus according to claim 1, wherein the said separate fluid reservoir is provided coaxially between an inner surface of an outer housing of the hydraulic actuator tool and the outer surface of a rod and is further bounded between an upper seal and a piston having a lower seal provided at the lower end of the rod and the hydraulic actuator tool is arranged to move fluid between the separate fluid reservoir and the said fluid chamber by moving said lower seal relative to said upper seal.

20. A method of cutting through or deforming a sidewall of a downhole tubular, the method comprising the steps of:

a) running an apparatus according to claim 1 into the throughbore of the downhole tubular;

b) moving said at least one radially moveable body member from a retracted position to an extended position such that the contact surface at least contacts the inner surface of the throughbore of the downhole tubular by introducing fluid from said separate fluid reservoir through said fluid port and into said fluid chamber;

c) moving said at least one radially moveable body member from the extended position to the retracted position by withdrawing fluid through said fluid port from said fluid chamber through said fluid port and into said separate fluid reservoir; and d) rotating the radially moveable body member around a longitudinal axis of the radially moveable body member.

21. The method according to claim 20, wherein the method further comprises repeating steps b), c) and d) as many times as required until the contact surface has made contact with 360° of the inner surface of the throughbore of the downhole tubular.

22. The method according to claim 20, wherein the radially moveable body member is rotated in step d) by an arc length equal to the arc length of the contact surface.

23. The method according to claim 20, wherein the arc length of the contact surface is 60°.

24. The method according to claim 20, wherein the radially moveable body member is rotated in step d) by an indexer tool connected thereto.

25. The method according to claim 20, wherein the apparatus is provided within a bottom hole assembly, and wherein the bottom hole assembly further comprises an anchor assembly, wherein the method further comprises the step of anchoring the bottom hole assembly and thus the apparatus in axial position within the wellbore.

* * * * *